US005758453A

United States Patent [19]

Inage

[11] Patent Number: 5,758,453

[45] Date of Patent: Jun. 2, 1998

[54] APPARATUS FOR CLOSING SLIDING DOORS ON VEHICLE

[75] Inventor: Akio Inage, Yokkaichi, Japan

[73] Assignee: Fuji Electric Co., Ltd., Japan

[21] Appl. No.: 713,397

[22] Filed: Sep. 13, 1996

[51] Int. Cl.[6] ..... E05C 7/06

[52] U.S. Cl. ..... 49/118; 49/139

[58] Field of Search ..... 49/116, 117, 118, 49/123, 139, 140

[56] References Cited

U.S. PATENT DOCUMENTS 3,745,765 7/1973 Reddy ..... 49/139
3,782,034 1/1974 Lynn et al. ..... 49/140 X
5,347,755 9/1994 Jaster et al. ..... 49/123 X

FOREIGN PATENT DOCUMENTS 2008485 1/1990 Japan ..... 49/140

*Primary Examiner*—Jerry Redman
*Attorney, Agent, or Firm*—Rossi & Associates

[57] ABSTRACT

A door closing apparatus facilitates simultaneously opening of a pair of sliding doors by pulling a manual release wire. Specifically, by pulling the manual release wire, a belt 82 fixed to the manual release wire moves with belt pulleys and two hooks to contact and move respective movable frames to the opening directions thereof. Due to these movements, permanent magnets 31A, 31B rotate, through respective racks to release the holding of the closed doors. Thus, the sliding doors can be opened manually.

4 Claims, 4 Drawing Sheets

APPARATUS FOR CLOSING SLIDING DOORS ON VEHICLE

FIELD OF THE INVENTION

The present invention relates to a door closing apparatus for automatically closing a pair of sliding doors disposed at a passenger entrance on a rolling stock, such as an electric car and a train. More specifically the present invention relates to a door closing apparatus which facilitates opening the sliding doors manually in the event of an emergency or at other times when it is really necessary to open the doors.

BACKGROUND

The Japanese Unexamined Laid Open Patent Application No. H06-115429 discloses a door closing apparatus which opens and closes a pair of sliding doors on vehicle with a linear motor and holds the doors in the closed state with a permanent magnet. FIG. 4 is a front view of a main part of this conventional door closing apparatus right before completing to close the doors, an FIG. 5 is a cross section along A—A of FIG. 4.

FIGS. 4 and 5 chiefly show an upper right side of a left one of the symmetrically arranged sliding door pair. A left sliding door 1A and a right sliding door 1B are hung with a plurality of door sheaves 3 on a supporting rail 2 extending horizontally along a side wall 5 of the vehicle. The sliding doors 1A and 1B open and close a passenger entrance of the vehicle. A stopper 74 is fixed to the side wall 5.

A coupling means 20 for coupling a slider **4*b* of a linear motor and the sliding door 1A includes a driving plate 21 fixed to the slider 4*b* and a passive plate 22 fixed to the sliding door 1A. The sliding door 1A is opened and closed with a gap X between the plates 21 and 22** in the opening-and-closing direction.

A movable magnetic pole 39 is fixed via an adjustable joint 38 to the sliding door 1A. A closed door holding means 30A is fixed to the side wall 5 facing opposite to the magnetic pole 39. The closed door holding means 30A includes a cylindrical permanent magnet 31A which magnetically fixes opposed facing N and S poles in the radial direction thereof and a pair of pole shoes 32A surrounding the N and S poles. Each of the pole shoes has a non-magnetic portion at the end thereof. In the state shown in FIG. 5, the closed door holding means 30A does not attract the movable magnetic pole 39, since the internal magnetic path of the closed door holding means 30A is open. When the permanent magnet 31A rotates by 90 degrees of angle from the position shown in FIG. 5, the internal magnetic path of the closed door holding means 30A is closed so that the closed door holding means 30A attracts the movable magnetic pole 39. Thus, the closed door holding means 30A releases and holds the closed state of the sliding door 1A by a quarter turn of permanent magnet 31A. Another closed door holding means 30B for the right sliding door 1B is independent from its counterpart 30A and arranged in mirror symmetry with respect to the closed door holding means 30A. Preferable holding power due to the magnetic force of the permanent magnet 31A is around 100 kg.

A gear 42 which couples with a rack 41 is fixed to the permanent magnets 31A of the closed door holding means 30A. The rack 41 and the gear 42 constitutes a movement converting means 40 for converting a linear movement to a rotational movement. The converting means 40 may comprise a link mechanism. The rack 41 is fixed to a movable frame 43 which moves on a not shown support mechanism in the opening-and-closing direction of the sliding doors so as to rotate the permanent magnet 31A by 90 degrees of angle.

An attracting-and-releasing means 50 is disposed between the slider **4*b* and the movable frame 43. The attracting-and-releasing means 50 includes an adjustable joint 51 and a magnet 52 for attracting the adjustable joint 51. The adjustable joint 51 is attracted to the magnet 52 when the adjustable joint 51 is positioned, e.g., within the gap X from the magnet 52, and the adjustable joint 51 is not attracted to the magnet 52 as far as the adjustable joint 51 is positioned for more than the gap X away from the magnet 52. Preferable attracting force of the attracting-and-releasing means 50 is around 10 kg. The attracting-and-releasing means 50** may comprise a latch mechanism.

A manual releasing means 60 constituting a remote operating mechanism which includes a flexible sheath 61 and a wire 62 is coupled to the movable frame 43. When the wire 62 is pulled by a not shown manual releasing lever, the permanent magnet 31A is rotated via the movable frame 43, i.e. the rack 41, and the closed door holding means 30A releases the held movable magnetic pole 39. A touch sensor 71 is disposed on the plane on which the closed door holding means 30A or 30B attracts the movable magnetic pole 39 as a safety measure for transmitting a signal indicating the closed state of the pertinent door.

The conventional door closing apparatus operates as follows. As the slider **4*b* of the linear motor moves in the closing direction, the coupling means 20 moves, with the gap X left behind, to close the sliding door 1A, and brings the attracting-and-releasing means 50 to the state right before the attraction. As the sliding door 1A further closes, the slider 4*b* drives the movement converting means 40 through the attracting-and-releasing means 50 to rotate the permanent magnet 31A. As the permanent magnet 31A rotates, the closed door holding means 30A operates to attract the movable magnetic pole 39. In association with this, since the slider 4*b* also moves the sliding door 1A to its closing direction, the closed door holding means 30A fixed to the side wall 5 holds the sliding door 1A in the closed state thereof via the movable magnetic pole 39. Since the magnetic path of the closed door holding means 30A is closed with the movable magnetic pole 39, the permanent magnet 31A** is self-held not to rotate.

As the slider **4*b* is moved in the opening direction within the gap X by the linear motor operated to open the sliding door 1A from the closed state thereof, the slider 4*b*, now allowed to move within the gap X of the coupling means 20, moves the attracting-and-releasing means 50 to the opening direction, though the closed door holding means 30A still keeps closing the sliding door 1A through the movable magnetic pole 39. Due to this movement, the slider 4*b* rotates the permanent magnet 31A through the attracting-and-releasing means 50 and the movement converting means 40, and the closed door holding means 30A releases the held movable magnetic pole 39, i.e., the closed sliding door 1A. Then, the sliding door 1A is fully opened through the coupling means 20 as the slider 4*b* further moves in the opening direction. In association with this, the attracting-and-releasing means 50 escapes from the attracted state and separates from the slider 4*b*, and the permanent magnet 31A is self-held to prepare for the next closing of the door with the attracting-and-releasing means 50**.

The operation for manually opening the closed doors 1A, 1B will be explained below. The slider **4*b* has a play space in which the slider 4*b* can move for the gap X in the opening direction even when the linear motor is not operated and the closed door holding means 30A keeps closing the sliding door 1A through the movable magnetic pole 39. Therefore, the permanent magnet 31A of the closed door holding means 30A is rotated to release the holding by the force for moving the slider 4***b*. The force for moving the slider 4*b* is enough to move the rack 41 or the movable frame 43. By pulling each wire for the sliding door 1A or 1B, the movable frame 43 for each sliding door is moved. Then, the sliding doors 1A, 1B may be opened manually by small operating force.

It takes a time for the conventional door closing apparatus to open both sliding doors 1A and 1B in emergency, since two wires 62, 62 of the manual releasing means 60 should be manipulated to open the both sliding doors 1A and 1B.

SUMMARY OF THE INVENTION

In view of the foregoing, it is an object of the invention to provide a door closing apparatus on vehicle which facilitates simultaneously opening both of the sliding doors 1A, 1B manually simply by pulling a string of wire for manual release of the closed door holding means for both sliding doors. Specifically, a flat belt, V-shaped belt, rope, chain or timing belt may be used for the belt of the wrapping connector mechanism, and the belt pulleys which are suited for the adopted belt are preferably used in the invention.

According to an aspect of the invention there is provided a door closing apparatus for closing sliding doors of a vehicle, which comprises: a support rail fixed to the vehicle's side wall; a pair of sliding doors hung on the support rail, the sliding doors being movable in opposite directions to each other; a pair of linear motors for driving the respective sliding doors, each of the linear motors including a slider; coupling means coupling with the respective sliding doors for gaps in the opening-and-closing direction of the respective sliding doors, each of the coupling means including a driving plate fixed to the slider and a passive plate fixed to the sliding door; movable magnetic poles fixed to the respective sliding doors; closed door holding means fixed to the side wall of the vehicle, each of the closed door holding means including a pair of pole shoes and a cylindrical permanent magnet sandwiched between the pole shoes, the permanent magnet being rotated for attracting or releasing the movable magnetic pole of the sliding door to hold or release the sliding door closed; attracting-and-releasing means for attracting and for releasing the respective sliders of the sliding doors immediately before the sliding doors are closed, the attracting-and-releasing means being disposed between the closed door holding means and the sliders; movement converting means, each including a movable frame movable linearly with respect to the side wall, for converting the linear movements of the attracting-and-releasing means to rotational movements of the permanent magnets through the movable frames; a wrapping connector mechanism including a pair of belt pulleys and a belt wound around the belt pulleys, the wrapping connector mechanism being arranged in parallel to the movable frames; at least one manual release wire, a terminal end thereof being connected to the belt's portion between the belt pulleys; two hook fixed to the belt or the terminal end of the at least one manual release wire, the hooks being made contact with the respective movable frames; and at least the belt being led through the movable frames' holes.

Advantageously, the door closing apparatus further includes a touch sensor disposed on the closed doer holding means' plane, thereon the closed door holding means attracts the movable magnetic pole; and a portion disposed on the movable magnetic pole corresponding to the touch sensor's central portion, the portion being made of an elastic material and formed to be slightly convex.

Advantageously, the door closing apparatus further includes a self-lubricating sheet interposed between the pole shoes and the permanent magnet of the closed door holding means.

As the sliders of the linear motors for the sliding doors move in the closing direction, the coupling means move with gaps left behind to close the sliding doors and bring the attracting-and-releasing means to the state right before the attraction. As the sliding doors are further closed, the sliders drive the movement converting means through the attracting-and-releasing means to rotate the permanent magnets. As the permanent magnets rotate, the closed door holding means operate to attract the respective movable magnetic poles. In association with this, since the sliders also move the sliding doors to the closing directions thereof, the closed door holding means fixed to the side wall hold the respective sliding doors in the closed state thereof through the movable magnetic poles.

As the sliders are moved in the opening direction within the gap by the linear motors operated to open the sliding doors from the closed state thereof, the sliders, now allowed to move within the gap of the coupling means, move the respective attracting-and-releasing means to the opening directions, though the closed door holding means still keep closing the sliding doors through the movable magnetic poles. Due to these movements, the sliders rotate the permanent magnets via the attracting-and-releasing means and the movement converting means, and the closed door holding means release the held movable magnetic poles, i.e., the closed sliding doors. Then, the sliding doors are fully opened through the coupling means as the sliders further move in the opening directions. In association with this, the attracting-and-releasing means separate from the sliders, and the permanent magnets are self-held to prepare for the next closing of the doors with the attracting-and-releasing means.

The sliders have respective play spaces, i.e. the gaps, in which the sliders can move in the opening direction even when the linear motors are not operated, and the closed door holding means keep closing the sliding door through the movable magnetic poles. Therefore, the permanent magnets of the closed door holding means are rotated to release the holding by the force for moving the sliders. The force for moving the sliders is enough to move the racks or the movable frames. Thereafter, the sliding doors may be opened manually by small operating force.

By pulling a string of manual release wire, the belt fixed to the wire moves with the belt pulleys, and two hooks contact and move the respective movable frames to the opening directions thereof. Due to these movements, the permanent magnets rotate, through the racks and gears, to release the holding of the closed doors. Now, the sliding doors can be opened manually.

Even if the touching portions of the respective touch sensors, disposed on the respective planes where the closed door holding means are attracted to the respective movable magnetic poles, are formed to be convex stripes due to the technical requirements for manufacturing, slightly convex portions, made of an elastic material, are disposed on the movable magnetic poles corresponding to the respective centers of the touch sensors. Due to this configuration, the attitudes of the movable magnetic poles are controlled until the slightly convex portions secures the contact thereof with the respective touch sensors, even when the movable magnetic poles are slant to the respective convex stripes. Thus, linear motors keep closing the sliding doors until the sliding doors are completely shut by the sufficient holding force.

By the provision of the self-lubricating sheets, the pole shoes and the permanent magnet may survive the many rotating cycles.

BRIEF DESCRIPTION OF THE DRAWINGS

The invention will be described with greater detail with reference to the accompanying drawings, wherein.

DETAILED DESCRIPTION OF THE PREFERRED EMBODIMENTS

Figure 1:
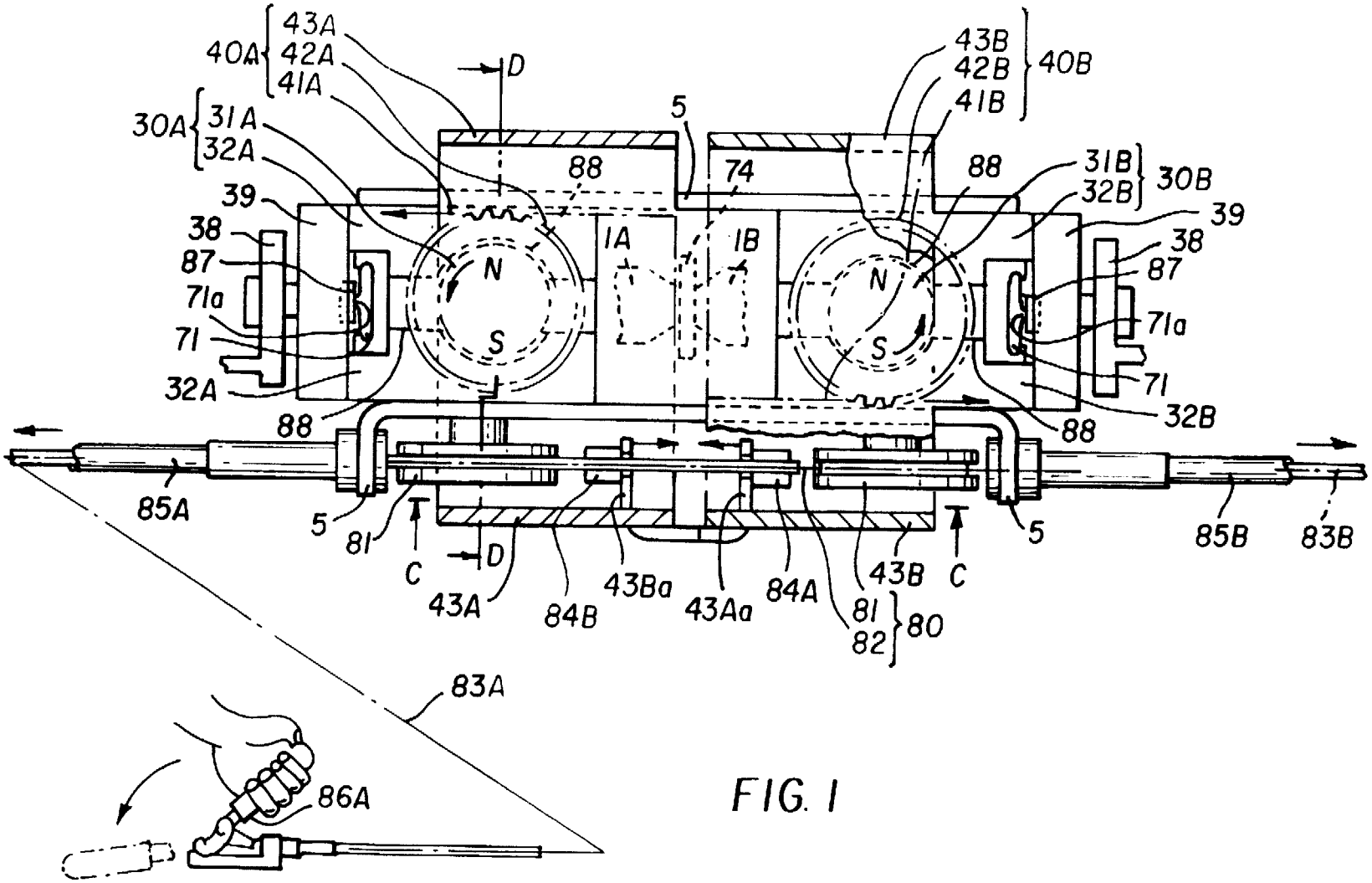
FIG. 1 is a cross section of an embodiment of a door closing apparatus according to the present invention showing a B—B cross section of FIG. 2.
Figure 4:
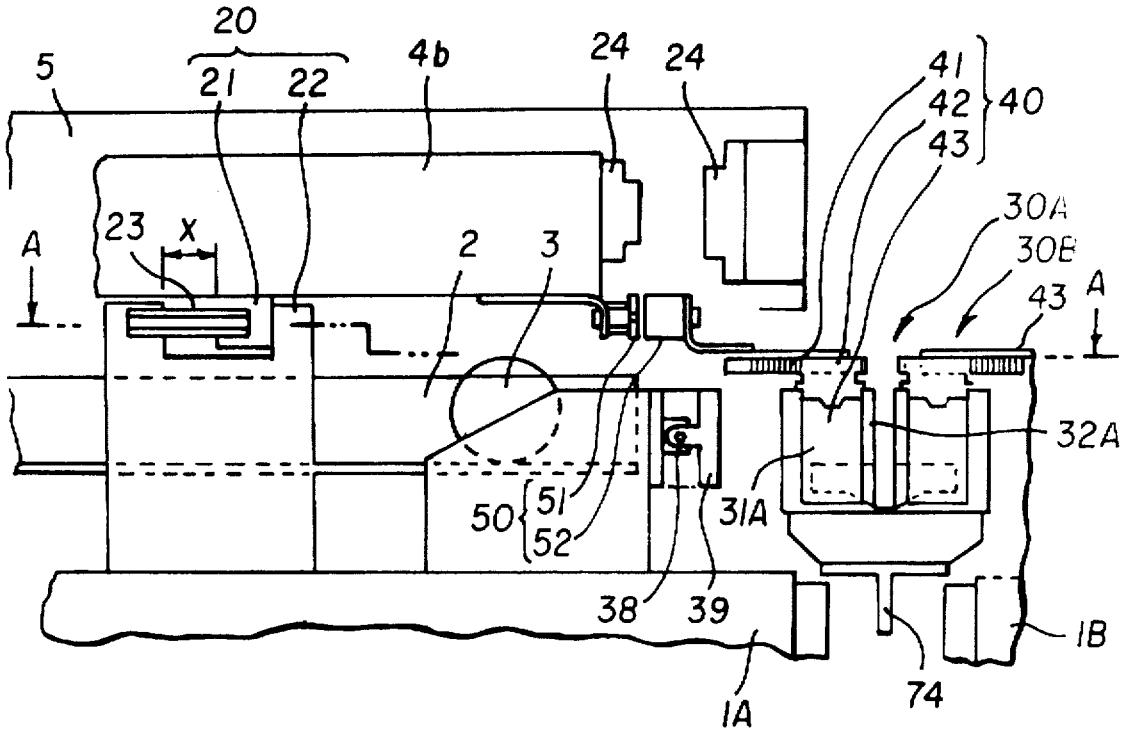
FIG. 4 is a front view of a main part of a conventional door closing apparatus immediately before completing to close the doors.
Figure 5:
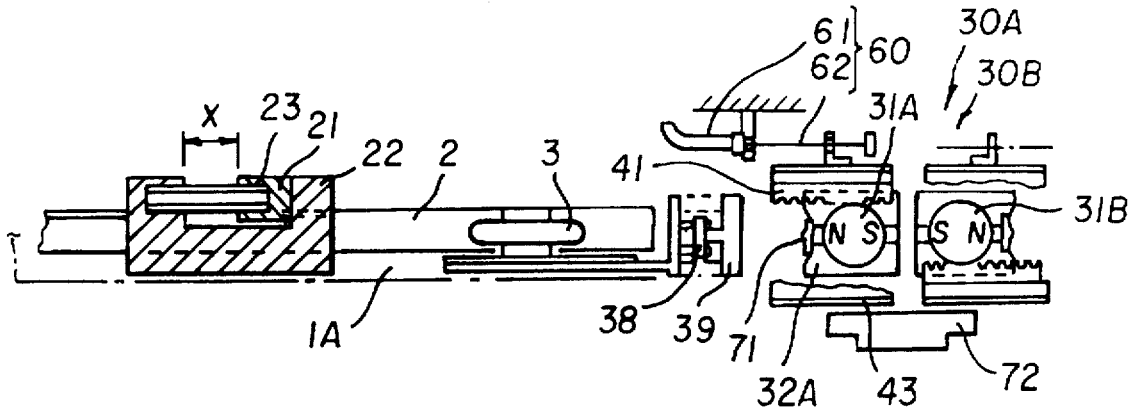
FIG. 5 is a cross section along A—A of FIG. 4.

The present invention will be explained hereinafter with reference to the drawing figures which illustrate the preferred embodiments of the invention. FIG. 1 is a cross section of an embodiment of a door closing apparatus according to the present invention. This figure shows a B—B cross section of FIG. 2 which is a C—C cross section of FIG. 1. FIG. 3 is a D—D cross section of FIG. 1. In these figures, the like parts with those of the prior art shown in FIGS. 4 and 5 are designated by the like reference numerals and their explanation will be omitted.

Figure 2:
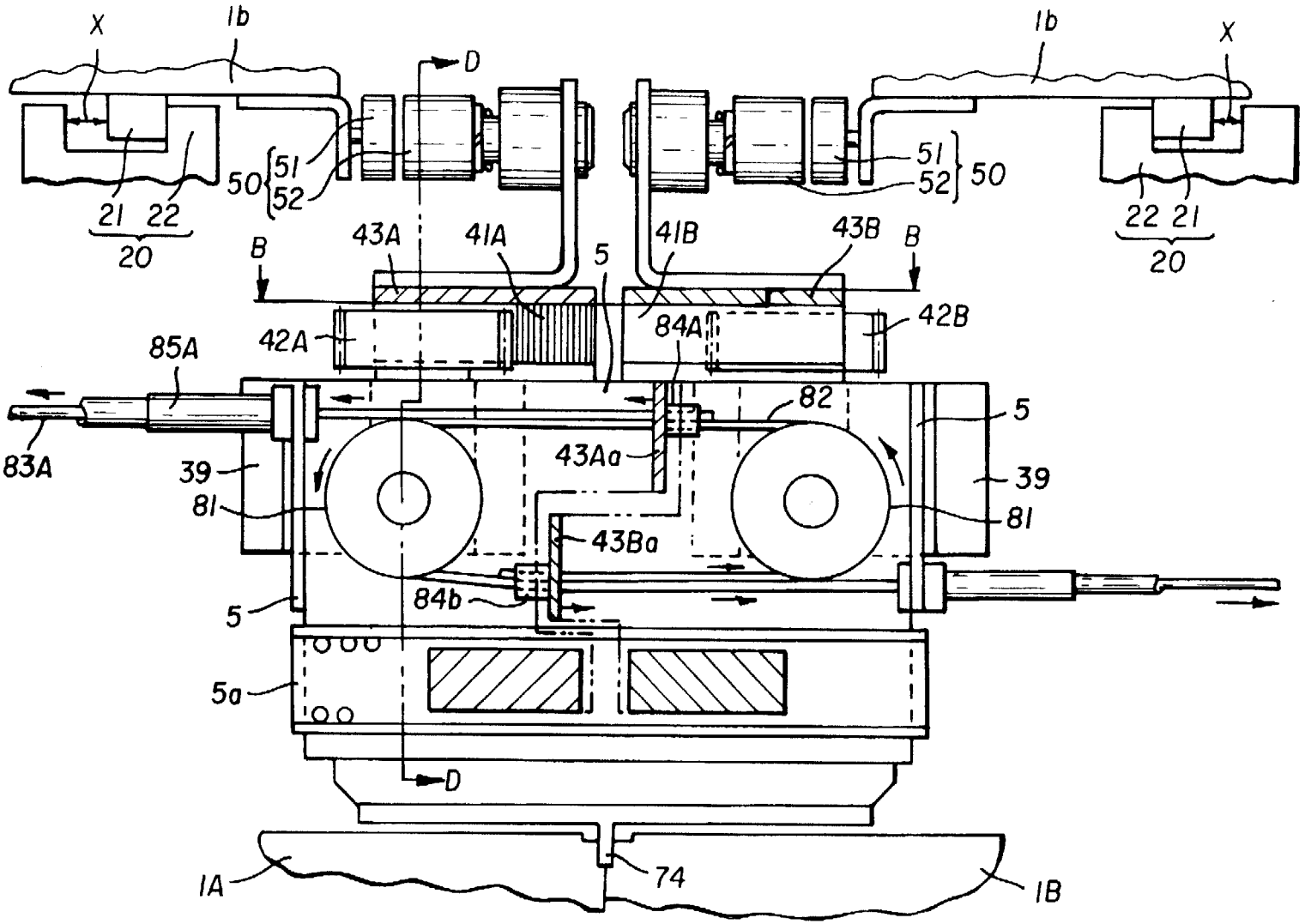
FIG. 2 is a C—C cross section of FIG. 1.
Figure 3:
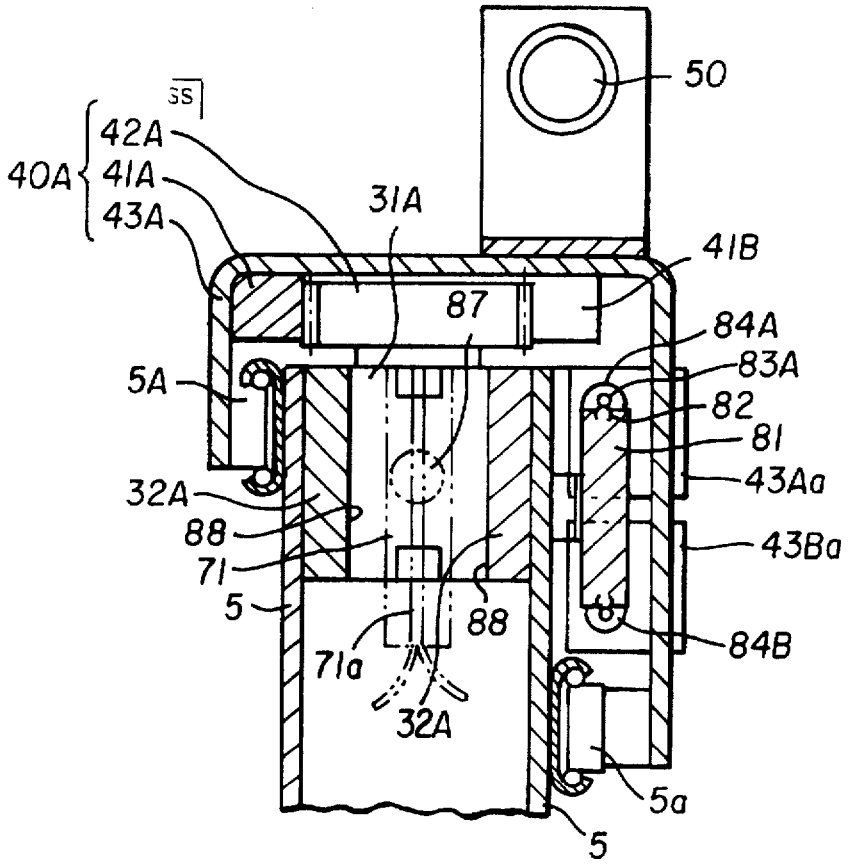
FIG. 3 is a D—D cross section of FIG. 1.

Referring now to FIGS. 1, 2, and 3, the like parts with those of FIGS. 4 and 5 will be explained at first. A left sliding door 1A and a right sliding door 1B are hung with a plurality of door sheaves (not shown, but similar to those of the prior art) on a supporting rail (not shown, but similar to that of the prior art) extending horizontally along a side wall 5 of the vehicle. The sliding doors 1A and 1B open and close a passenger entrance of the vehicle. A stopper 74 is fixed to the side wall 5. A coupling means 20 for coupling a slider 4*b* of a linear motor and the sliding door 1A or 1B includes a driving plate 21 fixed to the slider 4*b* and a passive plate 22 fixed to the sliding door 1A or 1B. The sliding door 1A or 1B is opened and closed with a gap X between the plates 21 and 22 in the opening-and-closing direction.

Movable magnetic poles 39, 39 are fixed via respective adjustable joints 38, 38 to the respective sliding doors 1A, 1B. Closed door holding means 30A, 30B are fixed to the side wall 5 facing opposite to the magnetic poles 39, 39. The closed door holding means 30A or 30B includes a cylindrical permanent magnet 31A or 31B which magnetically fixes opposed facing N and S poles in the radial direction thereof and a pair of pole shoes 32A or 32B surrounding the N and S poles. Each of the pole shoes has a non-magnetic portion at the end thereof. In the state shown in the figures, the closed door holding means 30A, 30B, with the internal magnetic paths thereof closed, attract the respective movable magnetic poles 39, 39. When the permanent magnets 31A, 31B rotate by 90 degrees of angle from the illustrated positions, the internal magnetic paths of the closed door holding means 30A, 30B are open not to attract the movable magnetic poles 39, 39. Thus, the closed door holding means 30A, 30B release and hold the closed state of the sliding doors 1A, 1B by a quarter turn of permanent magnets 31A, 31B.

Gears 42A and 42B which couple with respective racks 41A and 41B are fixed to the permanent magnets 31A and 31B of the closed door holding means 30A and 30B. The rack 41A or 41B and the gear 42A or 42B constitute a movement converting means 40A or 40B for converting a linear movement to a rotational movement. The movement converting means 40A, 40B may comprise a link mechanism. The rack 41A and 41B are fixed to respective movable frames 43A and 43B which move on a slide rail 5*a* fixed to the side wall 5 in the opening-and-closing direction of the sliding doors, and rotate the respective permanent magnets 31A and 31B by 90 degrees of angle.

An attracting-and-releasing means 50 is disposed between the slider 4*b* and the movable frame 43A or 43B. The attracting-and-releasing means 50 includes an adjustable joint 51 and a magnet 52 for attracting the adjustable joint 51. The adjustable joint 51 is attracted to the magnet 52 when the adjustable joint 51 is positioned, e.g., within the gap X from the magnet 52, and the adjustable joint 51 is not attracted to the magnet 52 as far as the adjustable joint 51 is positioned for more than the gap X away from the magnet 52.

As a specific feature of the embodiment, a wrapping connector mechanism 80 which includes a pair of belt pulleys 81, 81 and a belt 82 wound around the pulleys 81, 81 is arranged in parallel to a pair of the movable frames 43A, 43B. The belt 82 is connected, at a portion thereof between the pulleys 81, 81, to a terminal end of a manual release wire 83A, which is fixed to a hook 84A. The hook 84A is made contact to a portion 43A*a* of the movable frame 43A, and the belt 82 and the manual release wire 83A are led through a hole of the movable frame 43A. In the same manner as described above, the belt 82 is connected, at another portion thereof between the pulleys 81, 81, to a terminal end of a manual release wire 83B, which is fixed to another hook 84B. The hook 84B is made contact to a portion 43B*a* of the movable frame 43B, and the belt 82 and the manual release wire 83B are led through a hole of the movable frame 43B. The manual release wire 83A is led through a sheath 85A fixed to a fitting of the side wall 5, and the terminal end of the manual release wire 83A is connected to a manual release lever 86A. The manual release wire 83B is led through another sheath 85B fixed to another fitting on the side wall 5, and the terminal end of the manual release wire 83B is connected to another not shown manual release lever. It is sufficient to provide either one of the manual release levers. Alternatively, one of the manual release levers may be arranged inside the vehicle and another one outside the vehicle. The hook 84A which contacts with the movable frame 43A fixes both the belt 82 and the terminal end of the manual release wire 83A. Alternatively, the belt 82 and the terminal end of the manual release wire 83A may be fixed to another fitting. In this alternative, the fitting should be arranged so as not to run onto the pulley 81 over the entire stroke of the rack 41A during pulling the manual release wire 83A. The situations are the same for the hook 84B.

As another specific feature specific feature of the embodiment, touch sensors 71, 71, each thereof having a convex stripe 71*a* in the touching portion thereof, are disposed on respective planes where the closed door holding means 30A, 30B are attracted to the respective movable magnetic poles 39, 39. And, a slightly convex portion 87, made of an elastic material, is disposed on the movable magnetic pole 39 corresponding to the center of the touch sensor 71. Moreover, a self-lubricating sheet 88 is interposed between the pole shoes 32A, 32A or 32B, 32B of the closed door holding means 30A or 30B and the permanent magnet 31A or 31B.

The operation of the foregoing embodiment will be explained below. As the sliders 4b, 4b of the linear motors for the sliding doors 1A, 1B move in the closing direction, the coupling means 20, 20 move, with the gap X left behind, to close the sliding doors 1A, 1B and bring the attracting-and-releasing means 50, 50 to the state right before the attraction. As the sliding doors 1A, 1B are further closed, the sliders drive the movement converting means 40A, 40B through the attracting-and-releasing means 50, 50 to rotate the permanent magnets 31A, 31B. As the permanent magnets 31A, 31B rotate, the closed door holding means 30A, 30B operate to attract the respective movable magnetic poles 39, 39. In association with this, since the sliders 4b, 4b also move the sliding doors 1A, 1B to the closing directions thereof, the closed door holding means 30A, 30B fixed to the side wall 5 hold the respective sliding doors 1A, 1B in the closed sate thereof through the movable magnetic poles 39, 39.

As the sliders 4b, 4b are moved in the opening direction within the gap X by the linear motors operated to open the sliding doors 1A, 1B from the closed state thereof, the sliders, now allowed to move within the gap X of the coupling means 20, 20, move the respective attracting-and-releasing means 50, 50 to the opening directions, though the closed door holding means 30A 30A still keep closing the sliding doors 1A, 1B through the movable magnetic poles 39, 39. Due to these movements, the sliders 4b, 4b rotate the permanent magnets 31A, 31B through the attracting-and-releasing means 50, 50 and the movement converting means 40, 40, and the closed door holding means 30A, 30B release the held movable magnetic poles 39, 39, i.e., the closed sliding doors 1A, 1B. Then, the sliding doors 1A, 1B are fully opened through the coupling means 20, 20 as the sliders 4b, 4b further move in the opening directions. In association with this, the attracting and releasing means 50, 50 separate from the sliders 4b, 4b, and the permanent magnets 31A, 31B are self-held to prepare for the next closing of the doors with the attracting-and-releasing means.

The operation for manually opening the closed doors 1A, 1B will be explained below. The sliders 4b, 4b have respective play spaces, i.e. the gaps X, X in which the sliders 4b, 4b can move in the opening direction even when the linear motors are not operated, and the closed door holding means 30A, 30B keep closing the sliding door 1A, 1B through the movable magnetic poles 39, 39. Therefore, the permanent magnets 31A, 31B of the closed door holding means 30A, 30B are rotated to release the holding by the force for moving the sliders 4b, 4b. The force for moving the sliders 4b, 4b is enough to move the racks 41A, 41B or the movable frames 43A, 43B. Thereafter, the sliding doors 1A, 1B may be opened manually by small operating force.

By pulling a string of manual release wire 83A or 83B, the belt fixed to the wire moves with the belt pulleys 81, 81, and two hooks 84A, 84B contact and move the respective movable frames 43A, 43B to the opening directions thereof. Due to these movements, the permanent magnets 31A, 31B rotate, through the racks 41A, 41B and gears 42A, 42B, to release the holding of the closed doors 1A, 1B. Now, the sliding doors 1A, 1B can be opened manually.

Even if the touching portions of the respective touch sensors 71, 71, disposed on the respective planes where the closed door holding means 30A, 30B are attracted to the respective movable magnetic poles 39, 39, are formed to be convex stripes 71a, 71a due to the technical requirements for manufacturing, slightly convex portions 87, 87, made of an elastic material, are disposed on the movable magnetic poles 39, 39 corresponding to the respective centers of the touch sensors 71, 71. Due to this configuration, the attitudes of the movable magnetic poles 39, 39 are controlled until the slightly convex portions 87, 87 secures the contact thereof with the respective touch sensors 71, 71, even when the movable magnetic poles 39, 39 are slant to the respective convex stripes 71a, 71a. Thus, linear motors keep closing the sliding doors 1A, 1B until the sliding doors 1A, 1B are completely shut by the sufficient holding force. By the provision of the self-lubricating sheets 88 and 88, the pole shoes 32A, 32B and the permanent magnets 31A, 31B may survive the many rotating cycles.

As explained above, by pulling one of the manual release wires, the belt fixed to the pulled wire moves with the belt pulleys, and two hooks contact and move the respective movable frames to the opening directions thereof. Due to these movements, the permanent magnets rotate, through the movement converting means, to release the holding of the closed doors. Thus, the sliding doors can be opened manually.

Even when the touching portions of the respective touch sensors, disposed on respective planes where the closed door holding means are attracted to the respective movable magnetic poles, are formed to be convex stripes due to the technical requirements for manufacturing, slightly convex portions, made of an elastic material, are disposed on the movable magnetic poles corresponding to the respective centers of the touch sensors. Due to this configuration, the attitudes of the movable magnetic poles are controlled until the slightly convex portions secures the contact thereof with the respective touch sensors, even when the movable magnetic poles are slant to the respective convex stripes. Thus, linear motors keep closing the sliding doors until the sliding doors are completely shut by the sufficient holding force. By the provision of the self-lubricating sheets, the pole shoes and the permanent magnet may survive the many rotating cycles.

What is claimed:

1. A sliding door apparatus comprising:

first and second sliding doors hung on a support rail, the first and second sliding doors being movable in opposite directions to each other;

first and second linear motors for driving the first and second sliding doors, respectively, each of the linear motors including a slider;

coupling means associated with each slider, for coupling each slider to its respective sliding door in an opening-and-closing direction of the sliding door, each coupling means including a driving plate fixed to the slider and a passive plate fixed to the sliding door;

a movable magnetic pole fixed to each sliding door;

first and second closed door holding means attachable to a side wall of a vehicle, each closed door holding means including a pair of pole shoes and a cylindrical permanent magnet sandwiched between the pole shoes, the permanent magnet being rotated for attracting or releasing the movable magnetic pole of a corresponding one of said sliding doors to hold or release the corresponding sliding door in a closed position;

attracting-and-releasing means for attracting and for releasing the sliders before the sliding doors are closed, the attracting-and-releasing means being disposed between the closed door holding means and the sliders;

movement converting means associated with each sliding door, including a movable frame which moves on a slide rail, for converting the linear movements of the attracting-and-releasing means to rotational movements of the permanent magnets through the movable frames;

a wrapping connector mechanism including a pair of belt pulleys and a belt wound around the belt pulleys, the wrapping connector mechanism being arranged in parallel to the movable frames, the belt passing through holes in the movable frames;

at least one manual release wire, a terminal end of which is connected to the belt between the belt pulleys; and means for fixing the belt and the at least one manual release wire to the movable frame.

2. The door closing apparatus according to claim 1, further comprising:

a touch sensor associated with each closed door holding means; and a slightly convex portion of an elastic material disposed on the movable magnetic pole corresponding to opposite a central portion of the touch sensor, the central portion being made of an elastic material and formed to be slightly convex.

3. The door closing apparatus according to claim 1, further comprising a self-lubricating sheet interposed between the pole shoes and the permanent magnet of the closed door holding means.

4. A vehicle including sliding doors and a door closing apparatus closing the sliding doors of a vehicle, comprising:

a support rail fixed to a side wall of the vehicle;

first and second sliding doors hung on the support rail, the first and second sliding doors being movable in opposite directions to each other;

first and second linear motors for driving the first and second sliding doors, respectively, each of the linear motors including a slider;

coupling means associated with each slider, for coupling each slider to its respective sliding door in an opening-and-closing direction of the sliding door, each coupling means including a driving plate fixed to the slider and a passive plate fixed to the sliding door;

a movable magnetic pole fixed to each sliding door;

first and second closed door holding means attachable to the side wall of the vehicle, each closed door holding means including a pair of pole shoes and a cylindrical permanent magnet sandwiched between the pole shoes, the permanent magnet being rotated for attracting or releasing the movable magnetic pole of a corresponding one of said sliding doors to hold or release the corresponding sliding door in a closed position;

attracting-and-releasing means for attracting and for releasing the sliders before the sliding doors are closed, the attracting-and-releasing means being disposed between the closed door holding means and the sliders;

movement converting means associated with each sliding door, including a movable frame which moves on a slide rail, for converting the linear movements of the attracting-and-releasing means to rotational movements of the permanent magnets through the movable frames;

a wrapping connector mechanism including a pair of belt pulleys and a belt wound around the belt pulleys, the wrapping connector mechanism being arranged in parallel to the movable frames, the belt passing through holes in the movable frames, at least one manual release wire, a terminal end of which is connected to the belt between the belt pulleys; and means for fixing the belt and the at least one manual release wire to the movable frame.

* * * * *